US005887218A

United States Patent [19]

Yuu et al.

[11] Patent Number: 5,887,218

[45] Date of Patent: Mar. 23, 1999

[54] COLOR IMAGE FORMING APPARATUS HAVING TONER AND TRANSFER SHEET BEARING MEMBERS AND IMAGE FORMING METHOD THEREOF

[75] Inventors: Hideo Yuu, Tama; Mitsuru Seto, Yamakita-machi; Takashi Bisaiji, Yokohama; Naoko Iwata, Tokyo-to, all of Japan

[73] Assignee: Ricoh Co., Ltd., Tokyo, Japan

[21] Appl. No.: 872,051

[22] Filed: Jun. 10, 1997

[30] Foreign Application Priority Data

Jun. 10, 1996 [JP] Japan ..... 8-171866
Jul. 1, 1996 [JP] Japan ..... 8-191519

[51] Int. Cl.[6] ..... G03G 15/01; G03G 15/16

[52] U.S. Cl. ..... 399/44; 399/66; 399/302

[58] Field of Search ..... 399/44, 66, 302, 399/310

[56] References Cited

U.S. PATENT DOCUMENTS 5,278,613 1/1994 Bisaiji et al. ..... 399/66

FOREIGN PATENT DOCUMENTS 1-273074 10/1989 Japan .
6-161294 6/1994 Japan .

*Primary Examiner*—Joan Pendegrass
*Attorney, Agent, or Firm*—Oblon, Spivak, McClelland, Maier & Neustadt, P.C.

[57] ABSTRACT

An image forming apparatus in which a toner image formed on an image bearing member is first transferred onto an intermediate transfer element and then onto a transfer member. A potential of the image bearing member is detected and a transfer bias voltage applied to the intermediate transfer element is controlled according to the potential of the image bearing member. Undesired images such as transfer blurring due to discharge at the first transfer area, and a solid image scattering and so-called crow's claw mark due to increase of resistance of the transfer member under low absolute humidities are improved.

13 Claims, 7 Drawing Sheets

COLOR IMAGE FORMING APPARATUS HAVING TONER AND TRANSFER SHEET BEARING MEMBERS AND IMAGE FORMING METHOD THEREOF

BACKGROUND OF THE INVENTION

1. Field of the Invention

The present invention relates to an image forming apparatus such as a copying machine, a facsimile machine and a printer, and more particularly, to an image forming apparatus having bearing members for bearing toner, a transfer member and the transfer member with toner image which are conveyed to next process to produce an image formed transfer member.

2. Discussion of the Background

In recent years, electrophotographic image forming apparatus able to copy or print full color images have become practical to use. In these image forming apparatus, methods of transferring a full color image onto a transfer member are broadly classified into the following two types.

(a) Method using transfer drum:

Each of Yellow (Y), magenta (M), cyan (C) and black (Bk) images are formed one by one on an image bearing member such as a photoconductive drum and transferred onto a transfer member secured on a transfer drum to form a full color image thereon.

(b) Method using intermediate transfer element:

Each of yellow, magenta, cyan and black images are formed one by one on an image bearing member such as a photoconductive element or drum and individually transferred onto an intermediate transfer element at a first transfer nip part to form a full color image thereon. The full color image formed on the intermediate transfer element is then transferred onto a transfer member at a sheet transfer nip part at the same time.

Between these two methods, the method using an intermediate transfer element is advantageous because of being able to form a full color image even on a thick transfer member and to form an image even on a tip end part of a transfer member on which an image cannot be formed by the method using a transfer drum because the leading edge part is clamped to secure the transfer member.

In the method using an intermediate transfer element, when a material having a medium resistance (volume resistivity of $10^7$ to $10^{13}$ Ω·cm) is used as the intermediate transfer element, an undesirable image, so-called "transfer blurring" occurs in character images or line images after the toner images are transferred onto the intermediate transfer element.

Mechanism of the occurrence of the transfer blurring is considered as follows. By applying a predetermined transfer bias voltage to the intermediate transfer element at the first transfer nip part in which the photoconductive element contacts the intermediate transfer element to transfer the toner image from the photoconductive element to the intermediate transfer element, a transfer electric field is formed at the first transfer nip part, and thereby the toner image on the photoconductive element is electrostatically transferred onto the intermediate transfer element. If an insulator is utilized as the intermediate transfer element, the applied transfer bias voltage stays at the applied position (in this case, the first nip part) and has little if any effect on other parts of the intermediate transfer element.

However, in a case where a material having medium resistance is utilized as the intermediate transfer element, the applied transfer bias voltage affects the applied position as well as other parts of the intermediate transfer element. The transfer bias voltage affects both sides of the intermediate transfer element, namely, an upstream side and a downstream side in a moving direction of the intermediate transfer element, with respect to the voltage applied position.

When the transfer bias voltage affects an entrance of the first transfer nip part (a gap formed before the first transfer nip part in which the photoconductive element contacts the intermediate transfer element), an electric field is formed at the entrance of the first transfer nip part. This electric field causes so-called "pre-transfer" in which the toner image on the photoconductive element is transferred onto the intermediate transfer element before the photoconductive element contacts the intermediate transfer element at the first transfer nip part. Therefore, the toner image is pre-transferred onto a position of the intermediate transfer element slightly before the position to which the toner image should be transferred. As a result, the transferred toner image is wider and/or longer than the desired toner image, and the plural color toner images are superimposed on the intermediate transfer element not properly aligned. This is called "transfer blurring", and the final product is an undesirable image.

In the following discussion, a contacting part of the toner on the photoconductive drum and the intermediate transfer element (an intermediate transfer belt, for example), i.e., a first transfer area, is referred to as a first transfer nip part. Similarly, a contacting part of the toner on the intermediate transfer belt and the transfer member (sheet paper, for example), i.e., a second transfer area, is referred to as a second transfer nip part.

In the method using an intermediate transfer element, a drawback occurs in which undesirable images such as solid image scattering, and so-called "crow's claw mark," tend to occur in a toner image which is transferred to the transfer member from the intermediate transfer belt under low humidity environments. Solid image scattering is toner of a solid image scattered onto the background just before and after the transferred toner image in the feeding direction of the intermediate transfer element. The "crow's claw mark" is a streak-like high density toner image which looks like a crow's footmark observed in a half-tone image. It is believed that these phenomena occur due to occurrence of a difference between charge quantity on a front side of the transfer member on which the toner image is formed and charge quantity on a back side of the transfer member because the resistance of the transfer member is increased under low humidity environments.

More precisely, under low humidity environments, the charge quantity of the back side of the transfer member becomes greater than that of the front side of the transfer member after the transfer member is passed through the second transfer nip part. Therefore, the toner of the toner image on the transfer member scatters to the background just before and after the toner image along the electric field generated by the difference of the charge quantities of the front side and the back side of the transfer member, resulting in occurrence of solid image scattering. The "crow's claw mark" occurs by discharging due to the difference of the charge quantities of the front side and the back side of the transfer member.

SUMMARY OF THE INVENTION

Accordingly one object of the present invention is to provide an image forming apparatus capable of preventing transfer blurring occurring when an image is transferred from a photoconductive drum to an intermediate transfer belt at a first transfer nip part.

It is another object of the present invention to provide an image forming apparatus capable of preventing solid image scattering and so-called "crow's claw mark" which occur under low humidity environments.

To achieve such objects of the present invention, the present invention is directed to an image forming apparatus in which a toner image formed on an image bearing member is first transferred onto an intermediate transfer element and the transferred image on the intermediate transfer element is then secondly transferred onto a transfer member, wherein surface potential of the image bearing member is detected and a transfer bias voltage which is applied to the intermediate transfer element to transfer the toner image is controlled according to the surface potential of the image bearing member.

As a further feature of the present invention, the transfer bias voltage applied to the intermediate transfer element is changed according to an environmental condition surrounding the image forming apparatus. Preferably, the environmental condition represents absolute humidity.

As a further feature of the present invention, an image forming apparatus is provided in which an effective transfer bias voltage is detected at a position adjacent to the nip part of the image bearing member and the intermediate transfer element, i.e., first transfer nip part, and the transfer bias voltage applied to the intermediate transfer element is changed according to the effective transfer bias voltage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

An embodiment of the image forming apparatus of the present invention which is applied to an electrophotographic copier is now explained.

The present invention relates to an image forming apparatus having bearing members for bearing toner, an intermediate transfer element for transferring a toner image, and a conveying member conveying a transfer sheet on which the toner image is transferred to produce an image formed copy sheet. More precisely, the bearing members include an image bearing member which bears a toner image formed in a developing process and conveys the toner image by rotatively driving towards a first transfer process, an intermediate transfer element which bears the toner image transferred from the image bearing member and conveys the toner image by rotatively driving towards a second transfer process transferring the toner image onto a transfer member such as a transfer sheet, and a conveying member such as a conveyer belt which conveys the transfer sheet to the second transfer process and conveys the transfer sheet having the toner image from the second transfer process. Therefore, the present invention relates to not only image forming apparatus but also bearing members electrostatically bearing/conveying an image.

Figure 1:
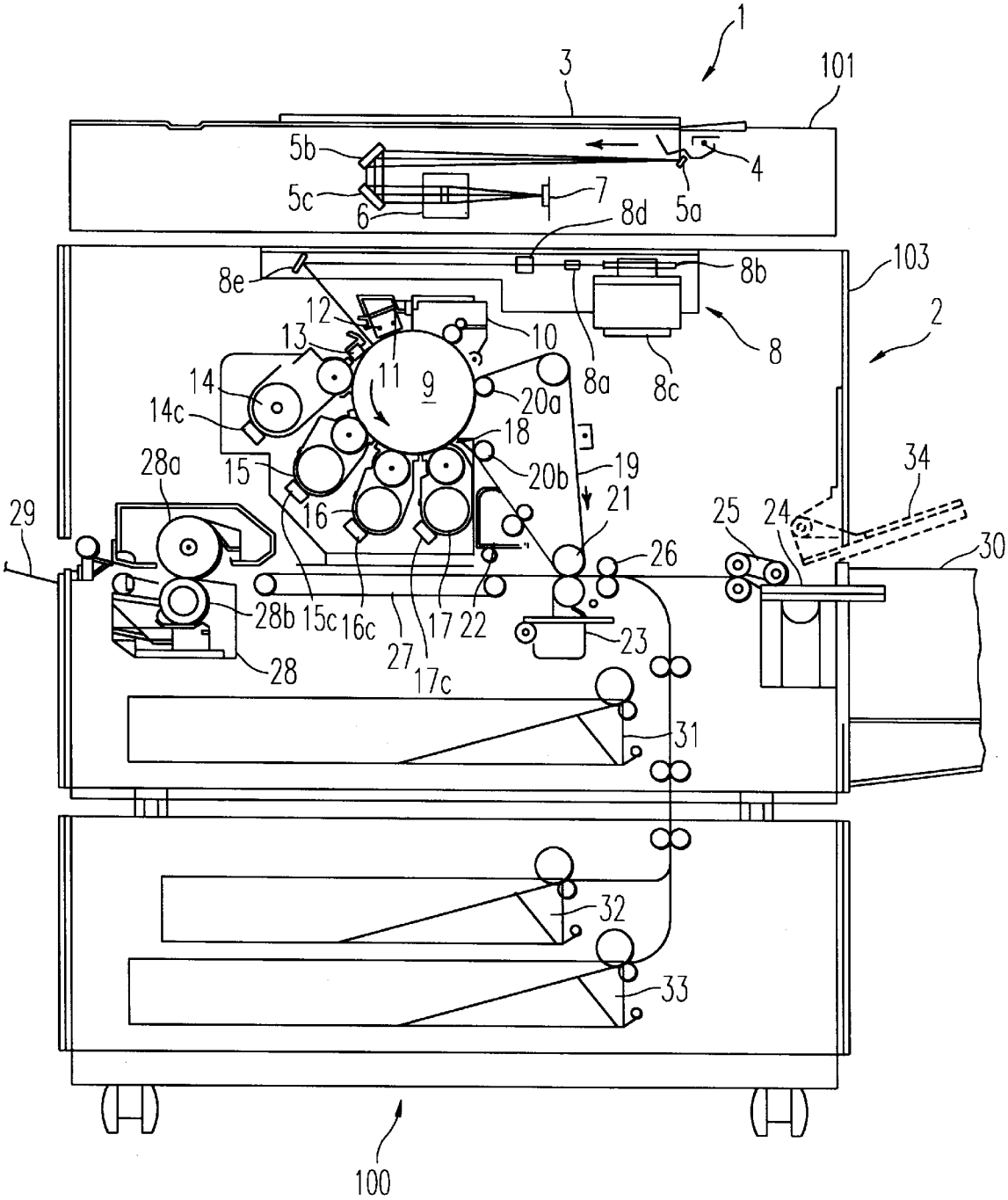
FIG. 1 a schematic view of a copying machine of an embodiment of the present invention.
Figure 2:
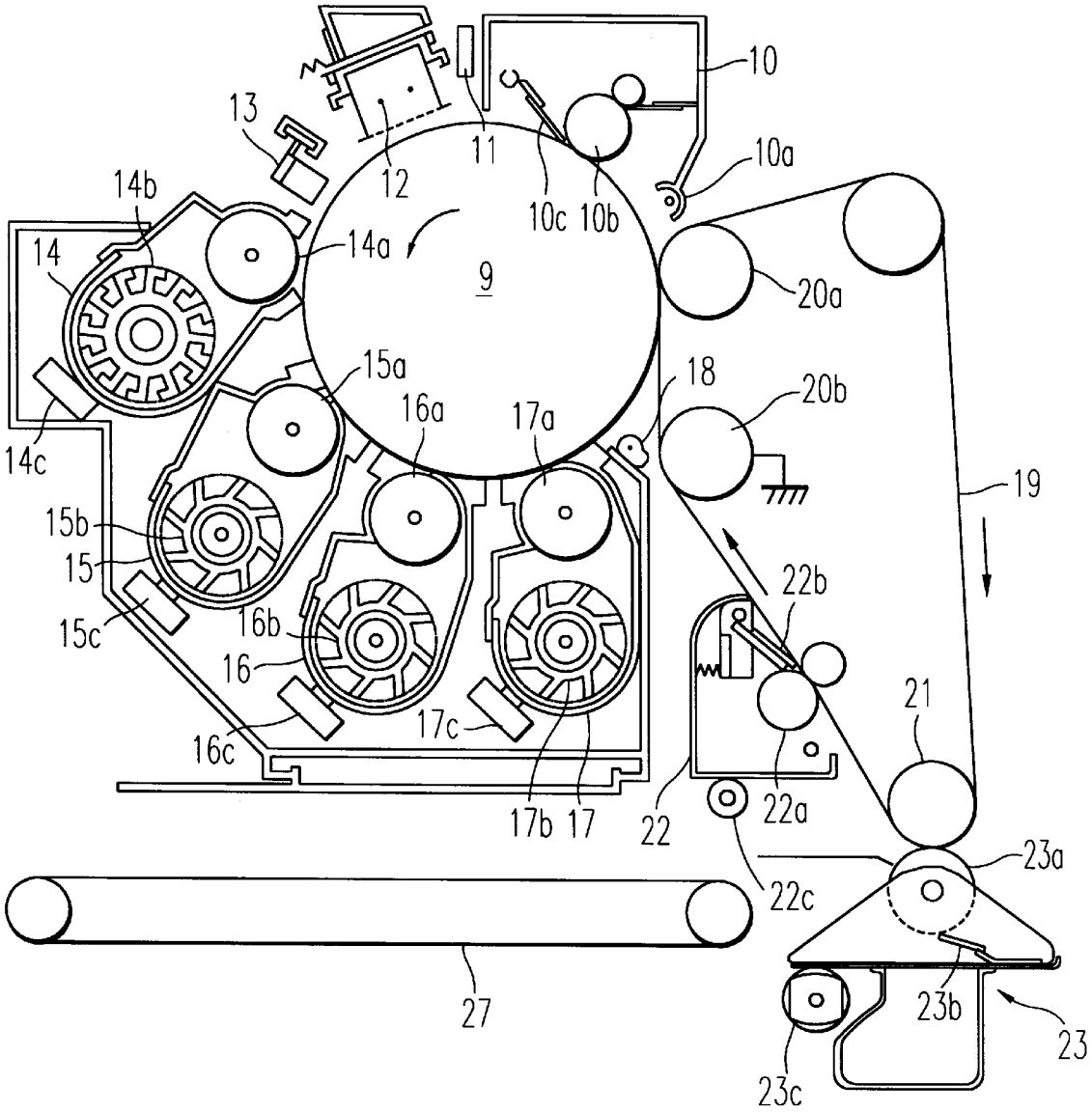
FIG. 2 is an enlarged view around a photoconductive element and an intermediate transfer belt.

Referring now to the drawings, wherein like reference numerals designate identical or corresponding parts throughout the several views, and more particularly to FIG. 1 thereof, there is illustrated a copying machine 100 of an embodiment of the present invention, and FIG. 2 is an enlarged view around a photoconductive drum 9, i.e., an image bearing member, and an intermediate transfer belt 19, i.e., an intermediate transfer element. The construction and the operation of the copying machine 100 are hereinafter explained referring to FIGS. 1 and 2.

In a color image reading unit (hereinafter referred to as a color scanner) 1, light from a lamp 4 irradiates an original document 3 to focus the image of the original document 3 on a color sensor 7 via mirrors 5*a* to 5*c* and a lens 6. The color sensor 7 reads the image of the original document as resolved color light images, for example, blue (hereinafter referred to as B), green (hereinafter G) and red (hereinafter referred to R), to convert the color light images into respective electric image signals.

The color sensor 7 includes a color resolving device for resolving the image to B, G and R light images, and a photoelectric converting element such as a CCD (Charge Coupled Device) which reads the three color light images at the same time. The resolved color light images of B, G and R are then converted to color images of Black (hereinafter referred to as Bk), Cyan (hereinafter C), Magenta (hereinafter M) and Yellow (hereinafter Y) depending on the image signal density level of the color light images of B, G and R by color conversion processing in an image processing section (not shown). The color image data of Bk, C, M and Y are then visualized by a color image recording unit (hereinafter referred to as a color printer) 2 to obtain a full color copy.

As to the operation of the color scanner 1 for obtaining the color image data of Bk, C, M and Y, the optical system including the lamp 4, the mirrors 5*a* to 5*c*, the lens 6 and the color sensor 7 moves to the left direction indicated by an arrow in FIG. 1 to scan the original document 3 and obtains one color image data per one scanning after receiving a scanner start signal timing to the operation of the color printer 2. The obtained first color image data are then formed by the color printer 2. By repeating the same operation, a full color image including four color toner images is obtained.

Next, operation of the color printer 2 is explained. An optical writing device 8 writes an image corresponding to the image of the original document 3 on a photoconductive drum 9 by converting the color image data from the color scanner 1 into optical signals to form an electrostatic latent image on the photoconductive drum 9. The optical writing device 8 includes a laser beam source 8*a*, a laser beam radiation driving controller (not shown), a polygon mirror 8*b*, a motor 8*c* for rotating the polygon mirror 8*b*, an fθ lens 8*d*, and a reflection mirror 8*e*.

As shown in FIG. 2, the photoconductive drum 9 rotates in a counterclockwise direction as indicated by an arrow and a photoconductive drum cleaning unit 10 (including a photoconductive drum discharging device which discharges remained charge on the photoconductive drum 9 before cleaning operation), a discharging lamp 11, a charging device 12, a potential sensor 13, a Bk color developing device 14, a cyan color developing device 15, a magenta color developing device 16, a yellow color developing device 17, an optical sensor 18 for detecting a developing density pattern and an intermediate transfer belt 19 are located around the photoconductive drum 9.

Each of the developing devices includes a developing sleeve (14*a*, 15*a*, 16*a* or 17*a*) which rotates to contact developing agent held in each respective developing device with the surface of the photoconductive drum 9 for developing the respective electrostatic latent image. A developing paddle (14*b*, 15*b*, 16*b* or 17*b*) rotates in each respective developing device to draw and stir respective developing agent, and a toner density sensor (14*c*, 15*c*, 16*c* or 17*c*) detects densities of respective developing agent. In a waiting state, all of the developing devices, including the developing sleeves and paddles, are in a shutdown state in which the flow of developing agent is cut off from contact with the surface of the photoconductive drum 9, i.e., the four developing devices cannot develop the latent images.

Next, copying operations are explained about an embodiment in which developing operations are performed in an order (color image forming order) of Bk, C, M and Y. However, color image forming is not limited to this order.

When copying operations are directed to start, a reading operation starts with a predetermined timing in which the color scanner 1 reads the Bk image data, and then an optical writing operation is performed using a laser beam to form a latent image on the photoconductive drum 9 (the latent image according to the Bk image data is hereinafter referred to as the Bk latent image, and each of the latent image according to the C, M and Y image data is also referred to as the C latent image, the M latent image and the Y latent image, respectively). Before the tip end portion of the Bk latent image reaches the developing position of the Bk developing device 14, the developing sleeve 14*a* is rotated, bringing the Bk developing agent (toner) in contact with the surface of the photoconductive drum 9, to develop the Bk latent image with the Bk toner from the tip end portion of the Bk latent image. This developing operation of the Bk latent image is continued until a rear end portion of the Bk latent image passes the Bk image developing position, and then the flow of the Bk developing agent (toner) to the developing sleeve 14*a* is cut off and the Bk developing device is immediately shut down to make the developing device 14 not work. This operation of cutting off the flow of the Bk developing agent is finished at least before the tip end portion of the C latent image reaches the Bk developing position. The operation of cutting off the flow of the Bk developing agent is further performed by changing the rotating direction of the Bk developing sleeve 14*a* to the reverse direction.

The Bk toner image formed on the photoconductive drum 9 is transferred onto the surface of the intermediate transfer belt 19 which is driven at the same speed as the photoconductive drum 9 (the toner image transfer from the photoconductive drum 9 to the intermediate transfer belt 19 is hereinafter referred to as first transfer). The first transfer is performed by applying a predetermined bias voltage to a transfer bias roller 20*a* while the photoconductive drum 9 contacts the intermediate transfer belt 19. The toner images of Bk, C, M and Y are formed one by one on the photoconductive drum 9 so that the four color toner images are aligned to form a full color toner image on the intermediate transfer belt 19. The four color toner images consisting of a full color image are then transferred onto the transfer sheet 24 together. The intermediate transfer belt unit will be explained later in detail.

After the Bk image forming process on the photoconductive drum 9, the C image forming process is started. A reading operation of the C image data by the scanner 1 are started with a predetermined timing, and then a latent image corresponding to the C image data is formed on the photoconductive drum 9 using a laser beam. The C developing device 15 develops the C latent image with C toner that flows by starting rotation of the C developing sleeve 15*a* after the rear end portion of the previous Bk latent image has passed but the tip end portion of the C latent image does not reach the developing position of the developing device 15. The developing operation of the C latent image area is continued, and similar to the case of the Bk developer, when the rear end part of the C latent image passes the C image developing position, the operation of cutting off the flow of the C developing agent, shutting down the C developing device 15, is performed to make the C developing device 15 not work. This operation is also finished before the tip end portion of the following M latent image reaches the C developing device 15.

Explanation of the image forming process for M and Y images is omitted because the image reading, latent image forming, and developing operations are the same as the aforementioned Bk and C image forming processes.

Next, the intermediate transfer belt unit is explained. The intermediate transfer belt 19 is movably positioned around a drive roller 21, a transfer bias roller 20*a*, a ground roller 20*b* and driven rollers, and the intermediate transfer belt is driven and controlled by a drive motor which is not shown. A belt cleaning unit 22 includes a brush roller 22*a*, a rubber blade 22*b* and an attaching/detaching mechanism 22*c*. The belt cleaning unit 22 is detached from the surface of the intermediate transfer belt 19 by the attaching/detaching mechanism 22*c* during the period from the first Bk color image is transferred until the fourth color toner image is transferred onto the intermediate transfer belt 19.

Each of four color toner images are transferred one by one onto the intermediate transfer belt 19 so that the four color toner images are aligned to form a full color toner image on the intermediate transfer belt 19.

A sheet transfer unit 23 includes a sheet transfer bias roller 23*a*, a roller cleaning blade 23*b*, and an attaching/detaching mechanism 23*c* which performs attaching/detaching operation against the intermediate transfer belt 19.

Although the bias roller 23*a* is usually detached from the surface of the intermediate transfer belt 19, the bias roller 23*a* timely presses the transfer sheet 24 towards the surface of the intermediate transfer belt 19 by the attaching/detaching mechanism 23*c* and a predetermined bias voltage is applied to the bias roller 23*a* to transfer the full color toner image formed on the surface of the intermediate transfer belt 19 onto the transfer sheet 24 in a single lump transfer.

The transfer sheet 24 is fed by a feed roller 25, and registration rollers pair 26 which are shown in FIG. 1, so that the full color image on the intermediate transfer belt 19 is transferred onto the appropriate position of the transfer sheet 24.

The intermediate transfer belt 19, is driven by one of the following three driving methods after the transfer of the first Bk toner image is finished. These three methods may be combined to optimize copying speed when various sizes of transfer sheets 24 are used.

(1) Uniform Speed Advance Method

1) The intermediate transfer belt 19 continues moving forward at a uniform speed even after the Bk toner image is transferred onto the intermediate transfer belt 19.

2) When the tip end portion of the Bk image on the surface of the intermediate transfer belt 19 reaches again the first transfer nip part, i.e., the contact point of the photoconductive drum 9 and the intermediate transfer belt 19, the next C toner image which has been timely formed on the photoconductive drum 9 is transferred on the same position of the Bk toner image.

3) By repeating the same operations, the M and Y images are transferred on the intermediate transfer belt 19, thus the four color toner images are superposed on the intermediate transfer belt 19.

4) After the fourth image, i.e., the Y toner image, is transferred onto the intermediate transfer belt 19, the intermediate transfer belt 19 continues moving forward, and the four color toner images on the intermediate transfer belt 19 are transferred onto the transfer sheet 24 in a single lump transfer to form a full color toner image on the transfer sheet 24.

(2) Skipping Advance Method

1) After the first transfer of the Bk toner image is finished, the intermediate transfer belt 19 is detached from the surface of the photoconductive drum 9, being skipped for a predetermined distance at a high speed in a forward direction, then being slowed down to rotate at the previous speed in the forward direction, and then attached again to the photoconductive drum 9.

2) When the tip end portion of the Bk toner image on the intermediate transfer belt 19 reaches again the first transfer position, the tip end portion of the following C toner image which has been timely formed on the photoconductive drum 9 is transferred on the same position of the tip end portion of the Bk toner image on the intermediate transfer belt. Thus the C toner image is accurately superposed on the Bk toner image.

3) By repeating the same operations, the M and Y images are transferred on the intermediate transfer belt 19, thus the four color toner images are superposed on the intermediate transfer belt 19.

4) After the fourth image, i.e., the Y toner image, is transferred onto the intermediate transfer belt 19, the intermediate transfer belt 19 continues moving forward, and the four color toner images on the intermediate transfer belt 19 is transferred onto the transfer sheet 24 in a single lump transfer to form a full color toner on the transfer sheet 24.

(3) Advance/Retreat (quick return) Method;

1) After the first transfer of the Bk toner image is finished, the intermediate transfer belt 19 is detached from the photoconductive drum 9, and then the belt 19 is returned at a high speed as soon as the intermediate transfer belt 19 is stopped. The returning motion continues until the tip end portion of the Bk toner image passes over the first transfer nip part and after the tip end portion of the Bk toner image has moved for a predetermined distance, the intermediate transfer belt 19 is stopped and brought to a waiting state.

2) When the tip end portion of the C toner image on the photoconductive drum 9 reaches a predetermined position which is located before the first transfer nip part, advancing motion of the intermediate transfer belt 19 is restarted. Further, the intermediate transfer belt 19 is attached again to the surface of the photoconductive drum 9. By the same method as mentioned above, the C toner image is accurately transferred onto the Bk image of the intermediate transfer belt 19.

3) By repeating the same operations, the M and Y images are transferred on the intermediate transfer belt 19, thus the four color toner images are superposed on the intermediate transfer belt 19.

4) After the fourth image, i.e., the Y toner image, is transferred onto the intermediate transfer belt 19, the intermediate transfer belt 19 continues moving forward, and the four color toner images on the intermediate transfer belt 19 is transferred onto the transfer sheet 24 in a single lump transfer to form a full color image on the transfer sheet 24.

The transfer sheet 24 onto which the four color toner images of the intermediate transfer belt 19 are transferred in a lump is conveyed towards a fixing unit 28 by a sheet conveying unit 27, and the four color toner images on the transfer sheet 24 are melted to be fixed on the transfer sheet 24 by a press roller 28*b* and a fixing roller 28*a* which is controlled to be a predetermined temperature. Then, a copy sheet having the full color toner image is discharged onto a copy tray 29.

As shown in FIG. 2, after the first transfer operation is finished, the surface of the photoconductive drum 9 is cleaned by a cleaning unit 10 including a pre-cleaning discharger 10*a*, a brush roller 10*b* and a rubber blade 10*c*, and remaining charge on the photoconductive drum 9 is uniformly discharged by the discharging lamp 11.

In addition, after the toner image is transferred onto the transfer sheet 24, the surface of the intermediate transfer belt 19 is cleaned by the cleaning unit 22 which is attached to the surface of the intermediate transfer belt 19 by the attaching/detaching mechanism 22*c*.

In a case of repeating the copying operation, the operation of the color scanner 1 and the image forming operation of the photoconductive drum 9 are repeated in which the image forming process of the Bk toner image (first color) of the second copy is timely started after the image forming process of the Y toner image (fourth color) of the first copy is finished.

The Bk toner image for the second copy is then transferred onto the same area of the intermediate transfer belt 19 whose surface is cleaned by the cleaning unit 22 after the four color toner images of the first copy are transferred in a single lump transfer onto the transfer sheet 24. After forming the Bk toner image of the second copy, the same operations as that for the first copy are repeated to form the second copy.

In the sheet feeding cassettes 30, 31, 32 and 33 shown in FIG. 1, different sizes of transfer sheets 24 are contained therein respectively, and a size of the transfer sheet 24 instructed to be fed by an operation panel (not shown) is timely fed from the contained cassettes and conveyed towards the registration rollers pair 26. A reference numeral 34 indicates a manual paper tray for feeding a transparent document transfer sheet for OHP (over head projection), a thick transfer sheet or the like.

The above explanation is how to obtain a full color copy including four colors. In a case of a three-color copy mode, or a two-color copy mode, the same operation as mentioned above is repeated a number of times so that the desired color images are superposed to form a color image having two or three colors. In a case of a mono-color copy mode, developing device of a selected color is made to be a state of readiness (the developing agent is allowed to flow), and the intermediate transfer belt 19 is driven at a constant speed in the forward direction while contacting the surface of the photoconductive drum 9 while a predetermined number of copies are made. Further, the copying operation is performed while the belt cleaning unit 22 is keeping contact with the intermediate transfer belt 19.

Next, embodiments of the aforementioned copying machine which are constructed for preventing occurrence of the transfer blurring in the first transfer is explained.

[Embodiment 1]

Figure 3:
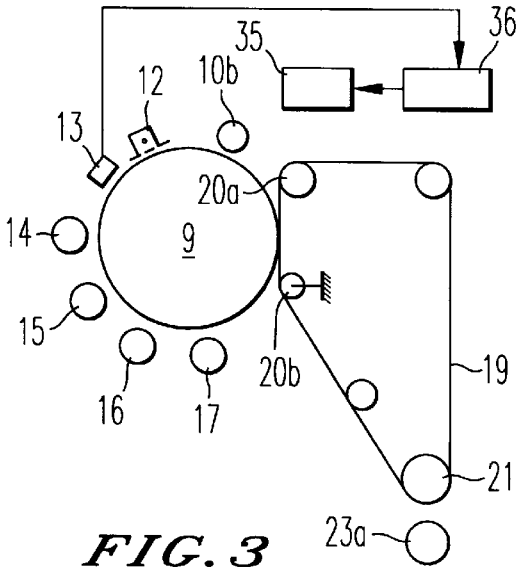
FIG. 3 is a block diagram showing construction of a control system layout in an embodiment of the present invention.

FIG. 3 is a block diagram showing construction of a control system of embodiment 1, and also showing construction around the photoconductive drum 9 and an intermediate transfer belt 19.

The control system of this embodiment includes a potential sensor 13 as a potential detecting device of the photoconductive element 9, a first transfer power source 35, and a first transfer electric field control device 36. The potential sensor 13 detects a surface potential of the photoconductive element 9, which is output to the first transfer electric field control device 36. The first transfer power source 35 applies a predetermined transfer bias voltage to the transfer bias roller 20*a*. The first transfer electric field control device 36 sets transfer bias voltage such that discharge is not generated at an entrance of the first transfer nip part in consideration of the potential of the photoconductive element 9, which will be described in detail later, and controls the first transfer power source 35 to apply the set transfer bias voltage.

Figure 4:
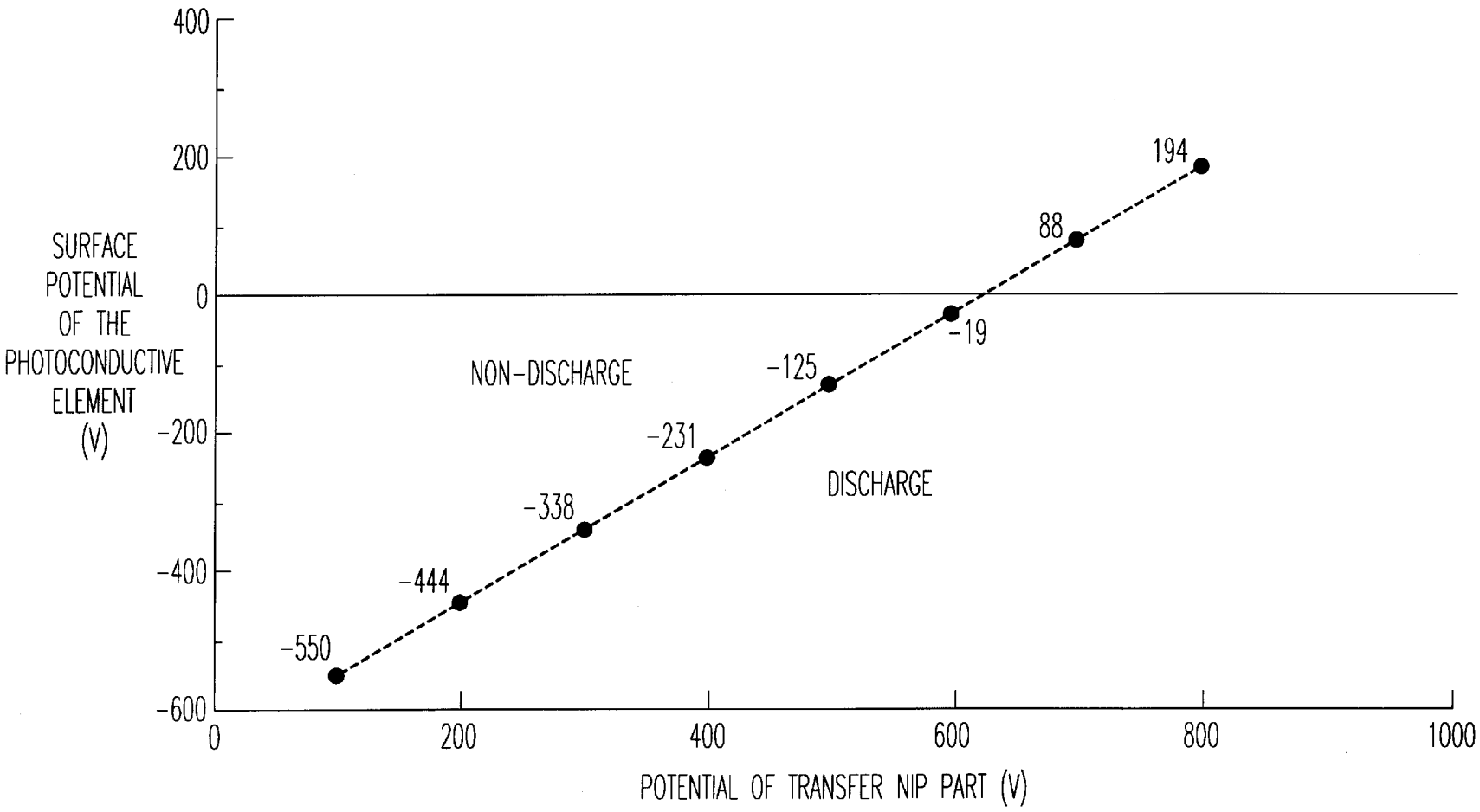
FIG. 4 is a graph showing relation between effective transfer potential and discharge in the first transfer nip part.

Relation between the surface potential of the photoconductive element 9 and the voltage to be applied at the first transfer nip part, representing an effective voltage, is explained hereinafter. FIG. 4 is a graph showing whether or not discharge occurs at the first transfer nip part. The vertical axis represents surface potentials of the photoconductive element 9, and the horizontal axis represents potentials of the first transfer nip part. In FIG. 4, when a point with coordinates (potential of the first transfer nip part, potential of the photoconductive element 9) is in the area above the broken line, discharge does not occur, however, when the point is in the area below the broken line, discharge does occur.

The first transfer electric field control device 36 controls the potential of the first transfer nip part so that the point with coordinates (applied potential of the first transfer nip part, detected potential of the photoconductive element 9) is in the area above the broken line in FIG. 4. Therefore, the first transfer electric field control device 36 sets a transfer bias voltage and controls the transfer bias voltage applied by the first transfer power source 35 so that the point with coordinates (effective potential of the first transfer nip part, detected potential of the photoconductive element 9) is in the area above the broken line in FIG. 4.

A copying machine having the above described construction can reduce transfer blurring caused by discharge which occurs during the first transfer operation. Because the applied transfer bias voltage is set on the basis of the detected surface potential of the photoconductive element 9 as described above, discharge at the entrance of the transfer nip part does not occur.

[Embodiment 2]

Figure 5:
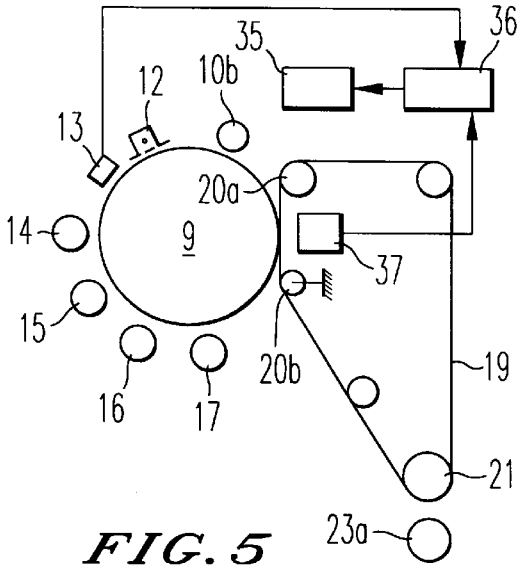
FIG. 5 is a block diagram showing construction of a first transfer nip part and a control system of a second embodiment of the present invention.

FIG. 5 is a block diagram showing construction of the transfer nip part in embodiment 2 and a control system thereof. At a position adjacent to the transfer nip part of embodiment 2, a first transfer nip part potential detecting device 37 is mounted which detects an effective potential of the intermediate transfer belt 19 at the transfer nip part and feeds back the effective potential to the first transfer electric field control device 36. Other construction is the same as that of embodiment 1 as shown in FIG. 3. In embodiment 1, the transfer bias voltage is set on the basis of the discharge properties shown in FIG. 4, however, an actual potential of the intermediate transfer belt 19 at the first transfer nip part is lower than the transfer bias voltage which is applied to the transfer bias roller 20*b*, because of a potential gradient between the transfer bias roller 20*a* and the ground roller 20*b*. Therefore, the effective potential of the intermediate transfer belt 19 at the first transfer nip part is detected by the first transfer nip part potential detecting device 37 and fed back to the first transfer electric field control device 36.

In a copying machine having construction as described above in embodiment 2, transfer blurring is prevented as in embodiment 1. However, the effective potential of the first transfer nip part is controlled more accurately in comparison with the construction of embodiment 1, because the actual effective potential of the intermediate transfer belt 19 at the first transfer nip part is detected and fed back to the first transfer electric field control device 36. Therefore, the transfer bias voltage applied by the first transfer power source 35 is controlled so that a point with coordinates (actual effective potential of the intermediate transfer belt 19, detected potential of the photoconductive element 9) is in the area above the broken line in FIG. 4.

[Embodiment 3]

Next, embodiment 3 is directed toward preventing the solid image scattering and the crow's claw mark that occur in low humidity environments.

Figure 6:
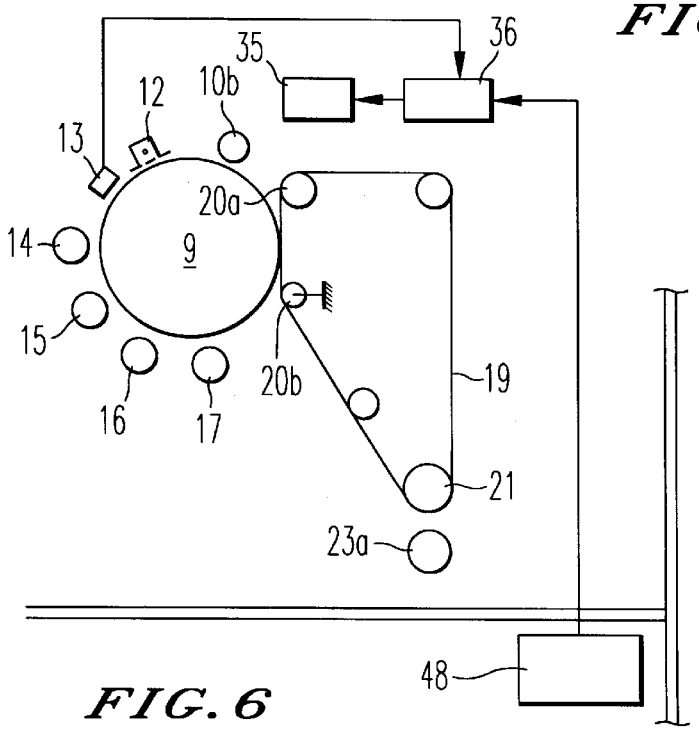
FIG. 6 is a block diagram showing construction of a first transfer nip part and a control system of a third embodiment of the present invention.

FIG. 6 is a block diagram showing construction of the first transfer nip part in embodiment 3 and construction of the control system thereof. In the control system of embodiment 3, a temperature and humidity detecting device 48 for detecting temperature and humidity of the environment is mounted. Other construction is the same as that of embodiment 1 shown in FIG. 3.

In embodiment 1, the transfer bias voltage is set based on the discharge properties shown in FIG. 4, however, the solid image scattering and the crow's claw mark tend to occur in low humidity environments as described before because of a difference between charge quantity of the front side of the transfer sheet 24 on which the toner image is formed and the charge quantity of the back side of the transfer sheet 24 whose resistance increases in low humidity environments. Therefore, in embodiment 3, the surrounding temperature and humidity are detected by the temperature and the humidity detecting device 48 and fed back to the first transfer electric field control device 36. Then the detected temperature and humidity are converted to the absolute humidity D ($g/m^3$) by the first transfer electric field control device 36, and the transfer bias voltage is changed according to the absolute humidity. Thus, an appropriate transfer bias voltage is applied to the intermediate transfer belt 19 according to environmental conditions.

The temperature and humidity detecting device 48 is mounted adjacent to a sheet feeding cassette in FIG. 6, however, the temperature and humidity detecting device 48 may be set anywhere the environmental condition is relatively stable. For example, a location without a heat source, blower, or other such apparatus nearby, would be appropriate.

Figure 7:
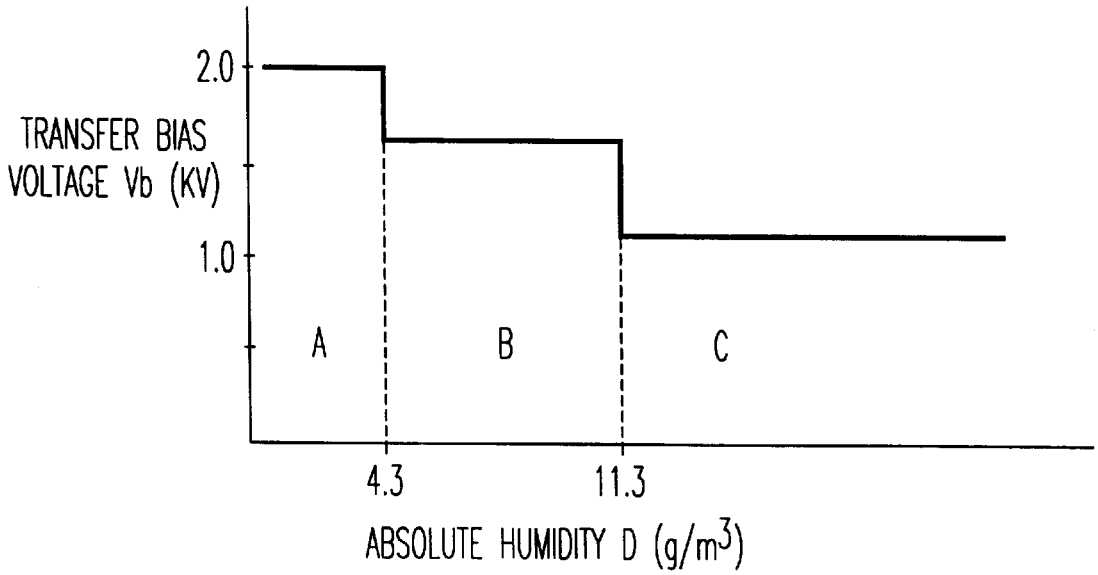
FIG. 7 is a graph showing a relationship between the environmental condition absolute humidity (D) and an upper limit value of a transfer bias voltage (Vb)

FIG. 7 is a graph showing relation between the absolute humidity D of the environment and the upper limit value of the transfer bias voltage. The vertical axis represents the transfer bias voltage Vb (kv), and the horizontal axis represents the absolute humidity D ($g/m^3$). The absolute humidity D is divided into three ranges, A ($D \leqq 4.3$), B ($4.3<D<g$ 11.3) and C ($11.3 \leqq D$). The upper limit value of the transfer bias voltage is respectively determined in each range of the absolute humidity D. The upper limit value of the transfer bias voltage is controlled to be 2000 v when the absolute humidity is in the range of less than or equal to 4.3 ($g/m^3$), to be 1600 v in the range from 4.3 ($g/m^3$) to 11.3 ($g/m^3$), and to be 1200 v in the range of more than or equal to 11.3 ($g/m^3$).

In a copying machine having the above described construction, a difference in charge quantities between the front side of the transfer sheet 24 on which the toner image is formed and the back side of the transfer sheet 24 decreases, because the lower the absolute humidity D of the environment becomes, the higher the upper limit value of the transfer bias voltage. Therefore, the solid image scattering and the crow's claw mark due to occurrence of the aforementioned difference of amount of charge can be prevented.

Figure 8:
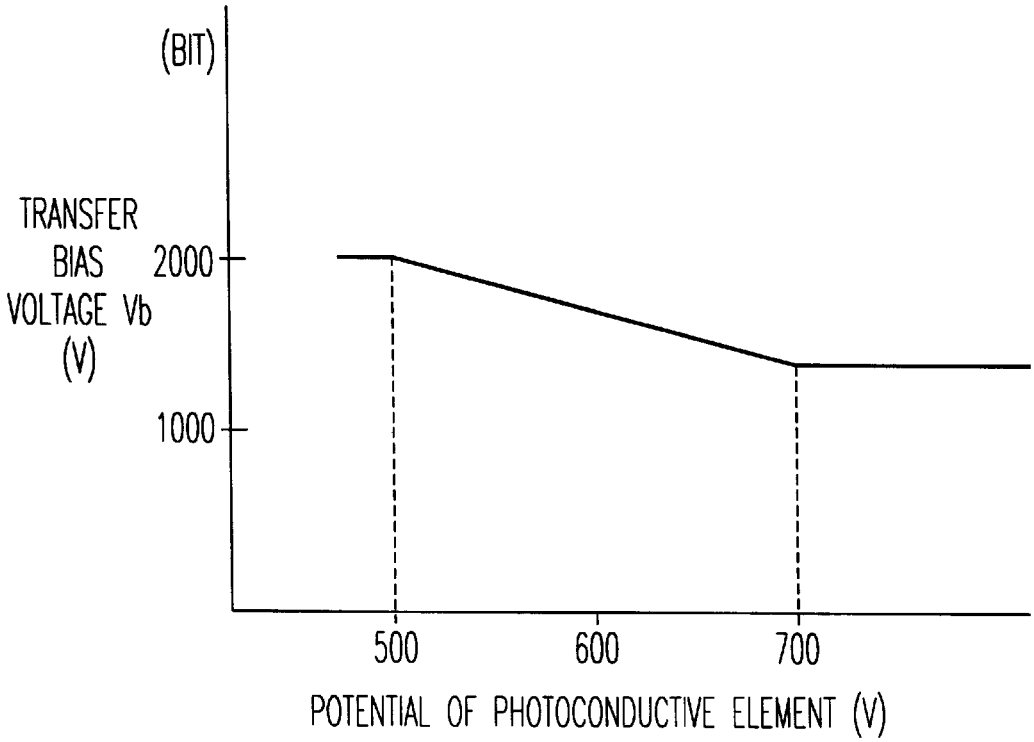
FIG. 8 is a graph showing a relationship between a detected potential of a photoconductive element (Vd) and suitable transfer bias voltage (Vb) at an area A in FIG. 7.

FIG. 8 is a graph showing the relation between the surface potential (Vd) of the photoconductive element 9 and the transfer bias voltage (Vb) in the range A in FIG. 7. In FIG. 8, the peak value of the transfer bias voltage (Vb) is the upper limit value of the transfer bias voltage (Vb) in the range A in FIG. 7. When the detected potential of the photoconductive element 9 is in a range from 500 v to 700 v, the potential of the photoconductive element 9 (Vd) in inversely proportional to the transfer bias voltage (Vb), i.e., the lower the potential of the photoconductive element 9 becomes, the higher the applied transfer bias voltage and visa versa. The same theory is also applied to the ranges B and C in FIG. 7. Namely, the lower the potential of the photoconductive element 9 becomes, the higher the applied transfer bias voltage, whose peak value set in the ranges B and C are the respective upper limit values in FIG. 7.

In a copying machine constructed as described above, the solid image scattering and the crow's claw mark which tend to occur under low humidity environments can be prevented by controlling the transfer bias voltage (Vb) according to the surface potential of the photoconductive element 9 and environmental conditions.

[Embodiment 4]

Figure 9:
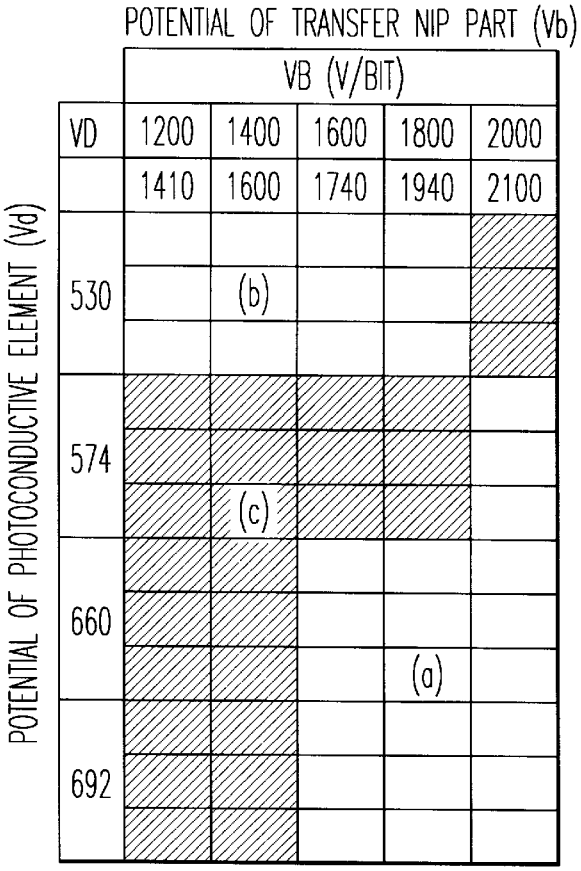
FIG. 9 is a diagram showing conditions in which the undesired images of a belt shaped white image, a solid image scattering, and a crow's claw mark occur.

FIG. 9 is a diagram showing conditions in which undesired images occur. The vertical axis represents the surface potential of the photoconductive element 9 (Vd) and the horizontal axis represents the potential of the transfer nip part (Vb). In the area indicated by (a), a belt shaped white image occurs in a halftone image. In the area (b), a solid image scattering and crow's claw mark occur. In the area (c) (shadowed area), the undesired images do not occur.

The potential of the intermediate transfer element 19 at the transfer nip part (Vb) are represented by two lines (upper and lower) of values (V/BIT). The upper values represent effective transfer bias potentials (V) at the first transfer nip part, and the lower values represent set values (BIT) of transfer bias voltages which are set by operation keys. In the description hereinafter, the value is represented, for example, "2000V/2100BIT" to distinguish each other. In addition, both of the potential of the intermediate transfer element 19 at the transfer nip part and the transfer bias voltage applied are represented by (Vb).

The first transfer electric field control device 36 controls the first transfer power source 35 so that the condition of the surface potential of the photoconductive element 9 and the potential of the intermediate transfer element 19 at the first transfer nip part is always in the area (c) in FIG. 9. Namely, the first transfer electric field control device 36 sets the transfer bias voltage so that condition of the potential of the intermediate transfer element 19 at the transfer nip part and the surface potential of the photoconductive element 9 detected by the potential sensor 13 is in the area (c) in FIG. 9. Thus, the transfer bias voltage applied is controlled by the first transfer power source 35 to prevent occurrence of the undesired images.

In a copying machine having the above described construction, the transfer bias voltage is controlled to be in the area (c) in FIG. 9 corresponding to the detected potential of the photoconductive element 9. Accordingly, the belt shaped white image caused by local excess of the transfer electric field due to uneven resistance of the intermediate transfer belt does not occur.

If the transfer bias voltage is increased as absolute humidity becomes lower, the belt shaped white image in a halftone image is conspicuously observed. Therefore, a diagram (graph information) showing the relation between the detected potential of the photoconductive element 9 (Vd) and the suitable transfer bias voltage (Vb) to be set is determined for each range of absolute humidity, and the transfer bias voltage is changed on the basis of the graph information. In the first transfer electric field control device 36 of this embodiment, this diagram (graph information) is stored for each range of absolute humidity. The first transfer electric field control device 36 changes the transfer bias voltage corresponding to the detected potential of the photoconductive element 9 using the graph information for the absolute humidity which is obtained using the detected data of the temperature and relative humidity of the environment.

The transfer bias voltage (Vb) is controlled corresponding to the potential of the photoconductive element 9 (Vd) using the following equations.

1. When the absolute humidity D is less than or equal to 4.3 $g/cm^3$, 1) if $Vd \leqq 530$, $Vb=2000(V)/2100(BIT)$;

2) if $530<Vd<660$,
$Vb=((-)5.3)\times\|Vb\|+(4908)$,
wherein (−)5.3 and 4908 are correction factors; and 3) if $660 \leqq Vd$,
$Vb=1200(V)/1410(BIT)$.

2. When the absolute humidity D is from 4.3 to 11.3, 1) if $Vd \leqq 530$, $Vb=1600(V)/1740(BIT)$;

2) if $530<Vd<660$,
$Vb=((-)\ 2.54)\times\|Vb)\|+(3086)$,
wherein (−)2.54 and 3086 are correction factors; and 3) if $660 \leqq Vd$,
$Vb=1200(V)/1410(BIT)$.

3. When the absolute humidity D is greater than or equal to 11.3, the transfer bias voltage (Vb) is controlled to be 1200(V)/1410(BIT) regardless of the potentials of the photoconductive element 9.

Figure 10:
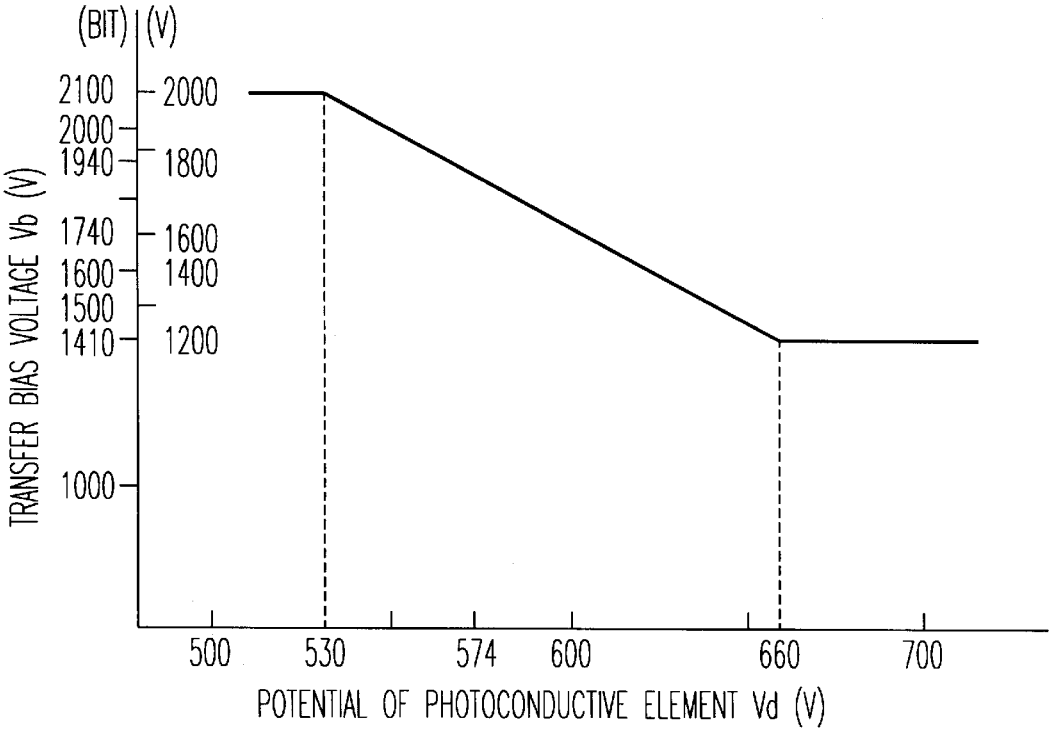
FIG. 10 is a graph showing a relationship between a detected potential of a photoconductive element and suitable transfer bias voltage in FIG. 7.
Figure 11:
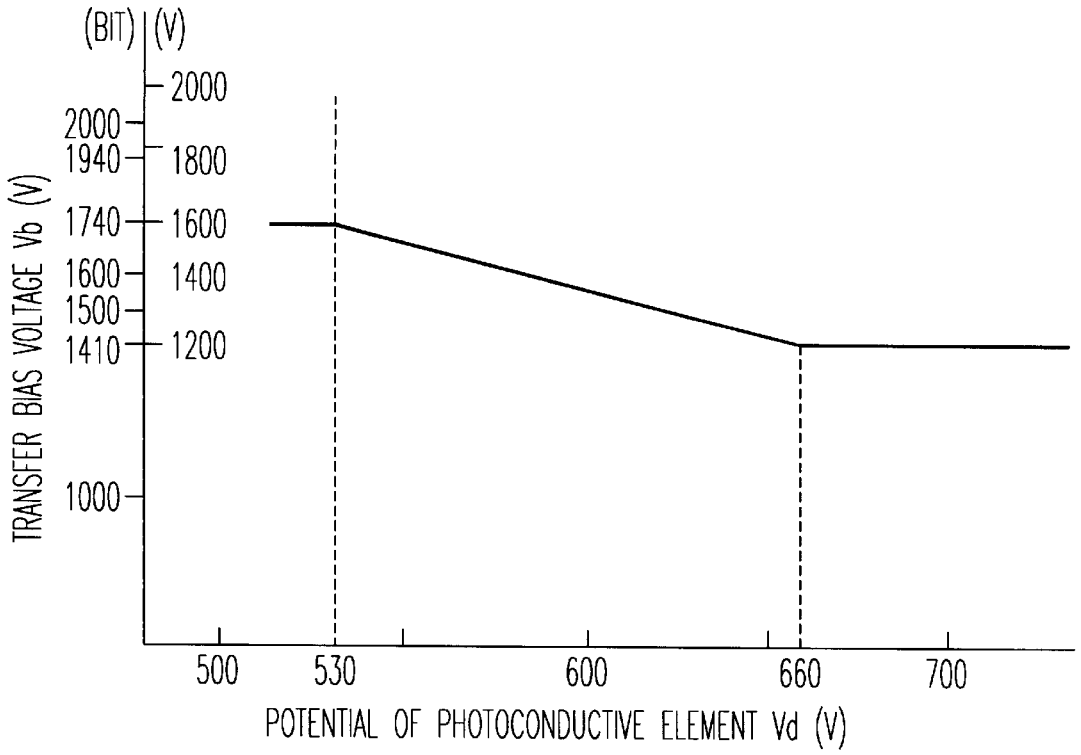
FIG. 11 is a graph showing a relationship between a detected potential of a photoconductive element and a suitable transfer bias voltage in an area B in FIG. 7.
Figure 12:
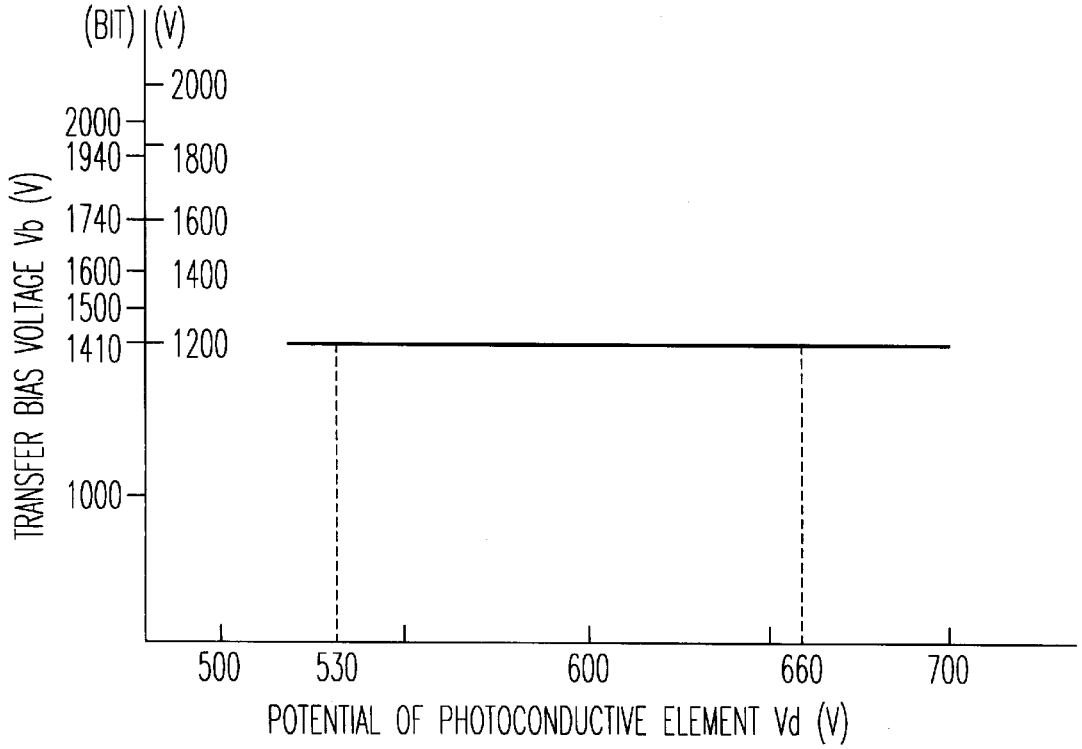
FIG. 12 is a graph showing a relationship between a detected potential of a photoconductive element and a suitable transfer bias voltage in an area C in FIG. 7.

FIG. 10 is a graph showing the relation between the detected potential of the photoconductive element 9 (Vd) and the suitable transfer bias voltage (Vb) in the area A in FIG. 7; FIG. 11 is a graph showing the relation between the detected potential of the photoconductive element 9 (Vd) and the suitable transfer bias voltage (Vb) in the area B in FIG. 7; and FIG. 12 is a graph showing the relation between the detected potential of the photoconductive element 9 (Vd) and the suitable transfer bias voltage (Vb) in the area C in FIG. 7. As shown in FIGS. 10 to 12, the lower the absolute humidity D becomes (C→A), the wider the changing range of the transfer bias voltage, and the higher the absolute humidity D becomes (A→C), the narrower the changing range of the transfer bias voltage. This is because, under relatively low humidity environments, not only the solid image scattering and the crow's claw mark tend to occur but also the belt shaped white image tends to be conspicuously observed in a halftone image, and a suitable transfer bias voltage is adjusted corresponding to the detected potential of the photoconductive element 9 so that the undesired images do not occur.

In consideration of using the copy machine in a temperature/humidity controlled room, this controlling operation of the transfer bias voltage may be selective, for example, by choosing a controlling mode or a non-controlling mode.

In a copying machine having the above described construction, the value of the transfer bias voltage is adjusted using the predetermined graph information which represents the relation of the detected potential of the photoconductive element and the suitable transfer bias voltage to be set corresponding to environmental conditions. Therefore, the occurrence of the undesirable images, i.e., not only the belt shaped white image in a halftone image but also solid image scattering and the crow's claw mark which tend to occur in relatively low humidities can be prevented at the same time.

In the copying machine of the present invention, not only the drum-shaped photoconductive element but also a belt-shaped photoconductive element or the like can be employed. Further, not only the belt-shaped intermediate transfer element but also drum-shaped intermediate transfer element or the like can be employed, and materials employed for the intermediate transfer element, physical properties such as electric properties i.e., volume resistivity and surface resistivity and thickness or structure (single layer or double layer) of the intermediate transfer element can be selected from various materials, values, and constructions suitable for the image forming conditions of the copying machines. Furthermore, regarding the first transfer voltage applying device i.e., first transfer bias roller 20*a* in FIG. 3, not only the roller but also brush, blade or the like can be employed, and the voltage is applied not only to a downstream side of the transfer nip position but also to the transfer nip position.

The voltage applied by the first transfer power source (reference numeral 35 in FIG. 3) is not limited to the values in the embodiments described above, and suitable values can be set according to the image forming conditions.

Regarding to a sheet transfer bias roller, (reference numeral 23*a* in FIG. 3), not only the roller but also brush, blade or the like can be employed.

This application is based on Japanese Patent Application No. 08-171866, filed on Jun. 10, 1996, and No. 08-191519 filed on Jul. 1, 1996, the entire contents of which are herein incorporated by reference.

Obviously, numerous modifications and variations of the present invention are possible in light of the above teachings. It is therefore to be understood that within the scope of the appended claims, the invention may be practiced otherwise that as specifically described herein.

What is claimed as new and desired to be secured by Letters Patent of the United States is:

1. An image forming apparatus comprising:

an image bearing member which is charged and then irradiated with light to form a latent image;

a potential sensor for detecting a potential of the image bearing member;

a developing member for developing the latent image with toner to form a toner image;

an intermediate transfer element on which the toner image is transferred onto from the image bearing member at a first transfer nip part and the transferred toner image is then transferred onto a transfer member at a sheet transfer nip part;

a transfer bias applying member for applying a transfer bias voltage to the intermediate transfer element;

a first transfer power source for applying the transfer bias voltage to the transfer bias applying member; and a first transfer electric field control device which determines the transfer bias voltage based on the detected potential of the image bearing member to be a value such that discharge is not generated at an entrance of said first transfer nip.

2. The image forming apparatus according to claim 1, further comprising:

a first transfer nip part potential detecting device which detects an effective potential of the intermediate transfer element at a position adjacent to the first transfer nip part;

wherein the transfer bias voltage to be applied is determined at least upon the effective potential of the intermediate transfer element.

3. The image forming apparatus according to claim 1, wherein the transfer bias applying member is a transfer bias roller rotating the intermediate transfer element.

4. An image forming apparatus comprising:

an image bearing member which is charged and then irradiated with light to form a latent image;

a potential sensor for detecting a potential of the image bearing member;

a developing member for developing the latent image with toner to form a toner image;

an intermediate transfer element on which the toner image is transferred onto from the image bearing member at a first transfer nip part and the transferred toner image is then transferred onto a transfer member at a sheet transfer nip part;

a transfer bias applying member for applying a transfer bias voltage to the intermediate transfer element;

a first transfer power source for applying the transfer bias voltage to the transfer bias applying member;

a first transfer electric field control device which determines the transfer bias voltage based on the detected potential of the image bearing member; and a temperature and humidity detecting device which detects a temperature and humidity of an environment surrounding the image forming apparatus;

wherein the transfer bias voltage to be applied is determined at least upon an absolute humidity obtained from information of the temperature and humidity detected by the temperature and humidity detecting device.

5. The image forming apparatus according to claim 4, wherein the transfer bias voltage to be applied is determined in a relationship with the absolute humidity such that as absolute humidity becomes lower, the transfer bias voltage to be applied becomes higher.

6. The image forming apparatus according to claim 4, wherein absolute humidity is divided into plural ranges, and as the absolute humidity as obtained from the information of the temperature and humidity detecting device falls into a lower range of said plural ranges, the transfer bias voltage to be applied becomes higher.

7. An image forming apparatus comprising:

an image bearing member which is charged and then irradiated with light to form a latent image;

a potential sensor for detecting a potential of the image bearing member;

a developing member for developing the latent image with toner to form a toner image;

an intermediate transfer element on which the toner image is transferred onto from the image bearing member at a first transfer nip part and the transferred toner image is then transferred onto a transfer member at a sheet transfer nip part;

a transfer bias applying member for applying a transfer bias voltage to the intermediate transfer element;

a first transfer power source for applying the transfer bias voltage to the transfer bias applying member;

a first transfer electric field control device which determines the transfer bias voltage based on the detected potential of the image bearing member; and a selecting device for selecting one of a controlling mode in which the first transfer electric field control device controls the transfer bias voltage and a non-controlling mode in which the first transfer electric field control device does not control the transfer bias voltage.

8. An image forming apparatus comprising:

an image bearing member which is charged and then irradiated with light to form a latent image;

a potential sensor for detecting a potential of the image bearing member;

a developing member for developing the latent image with toner to form a toner image;

an intermediate transfer element on which the toner image is transferred onto from the image bearing member at a first transfer nip part and the transferred toner image is then transferred onto a transfer member at a sheet transfer nip part;

a transfer bias roller rotating the intermediate transfer element for applying a transfer bias voltage to the intermediate transfer element;

a first transfer power source for applying the transfer bias voltage to the transfer bias applying member;

a first transfer electric field control device which determines the transfer bias voltage based on the detected potential of the image bearing member; and a ground roller connected to a ground potential for rotating the intermediate transfer element and forming the first transfer nip part in cooperation with the transfer bias roller.

9. An image forming method, comprising the steps of:

charging an image bearing member;

irradiating light onto the image bearing member to form a latent image thereon;

developing the latent image with toner to form a toner image on the image bearing member;

detecting a potential of the image bearing member;

applying a transfer bias voltage to an intermediate transfer element, which is determined based on at least the detected potential of the image bearing member;

transferring the toner image on the image bearing member onto the intermediate transfer element at a first transfer nip part;

transferring the toner image on the intermediate transfer element onto a transfer member at a sheet transfer nip part to be a value such that discharge is not generated at an entrance of said first transfer nip.

10. The image forming method according to claim 9, further comprising the steps of:

detecting an effective potential of the intermediate transfer element at a position adjacent to the first transfer nip part; and determining the transfer bias voltage to be applied based on at least the detected effective potential of the intermediate transfer element.

11. An image forming method comprising the steps of:

charging an image bearing member;

irradiating light onto the image bearing member to form a latent image thereon;

developing the latent image with toner to form a toner image on the image bearing member;

detecting a potential of the image bearing member;

applying a transfer bias voltage to an intermediate transfer element, which is determined based on at least the detected potential of the image bearing member;

transferring the toner image on the image bearing member onto the intermediate transfer element at a first transfer nip part;

transferring the toner image on the intermediate transfer element onto a transfer member at a sheet transfer nip part;

detecting temperature and humidity information of an environment surrounding the image forming apparatus;

converting the temperature and humidity information into absolute humidity; and determining the transfer bias voltage to be applied based on at least the absolute humidity.

12. The image forming method according to claim 11, wherein said step of determining the transfer bias voltage to be applied comprises the substep of:

adjusting the transfer bias voltage to be applied such that as absolute humidity becomes lower, transfer bias voltage to be applied becomes higher.

13. The image forming method according to claim 11, further comprising the steps:

determining plural ranges of absolute humidity;

wherein said step of determining the transfer bias voltage to be applied comprises the substep of:

adjusting the transfer bias voltage to be applied such that as absolute humidity falls into a lower range of said plural ranges, the transfer bias voltage to be applied becomes higher.

* * * * *